US005396263A

United States Patent [19]

Seiler et al.

[11] Patent Number: 5,396,263

[45] Date of Patent: Mar. 7, 1995

[54] WINDOW DEPENDENT PIXEL DATATYPES IN A COMPUTER VIDEO GRAPHICS SYSTEM

[75] Inventors: Larry D. Seiler, Boylston; James L. Pappas, Leominster; Robert C. Rose, Hudson, all of Mass.

[73] Assignee: Digital Equipment Corporation, Hudson, Mass.

[21] Appl. No.: 849,784

[22] Filed: Mar. 10, 1992

Related U.S. Application Data

[63] Continuation of Ser. No. 206,031, Jun. 13, 1988, abandoned.

[51] Int. Cl.[6] ..... G09G 1/06

[52] U.S. Cl. ..... 345/115; 345/199

[58] Field of Search ..... 340/724, 721, 723, 728, 340/703; 345/115, 118, 119, 121, 150, 153, 154, 155, 199, 186, 187, 188, 189, 190, 191

[56] References Cited

U.S. PATENT DOCUMENTS

| | | | |
|---|---|---|---|
| 4,204,206 | 5/1980 | Bakula et al. | 340/721 |
| 4,386,410 | 5/1983 | Pandya et al. | 364/518 |
| 4,412,294 | 10/1983 | Watts et al. | 364/518 |
| 4,439,760 | 3/1984 | Fleming | 340/799 |
| 4,484,187 | 11/1984 | Brown et al. | 340/703 |
| 4,496,944 | 1/1985 | Collmeyer et al. | 340/723 |
| 4,509,043 | 4/1985 | Mossaides | 340/721 |
| 4,542,376 | 9/1985 | Bass et al. | 340/724 |
| 4,545,070 | 10/1985 | Miyagawa et al. | 382/48 |
| 4,550,315 | 10/1985 | Bass et al. | 340/703 |
| 4,642,621 | 2/1987 | Nemoto et al. | 340/721 |
| 4,642,790 | 2/1987 | Minshull et al. | 364/900 |
| 4,651,146 | 3/1987 | Lucash et al. | 340/721 |
| 4,670,752 | 6/1987 | Marcoux | 340/721 |
| 4,679,038 | 7/1987 | Bantz et al. | 340/721 |
| 4,688,033 | 8/1987 | Carini et al. | 340/800 |
| 4,694,288 | 9/1987 | Harada | 340/721 |
| 4,700,320 | 10/1987 | Kapur | 364/521 |
| 4,710,761 | 12/1987 | Kapur et al. | 340/721 |
| 4,710,767 | 12/1988 | Sciacero et al. | 340/799 |
| 4,716,460 | 12/1987 | Benson et al. | 358/140 |
| 4,720,803 | 1/1988 | Ishii | 364/521 |
| 4,727,425 | 2/1988 | Mayne et al. | 358/80 |
| 4,736,200 | 4/1988 | Ounuma | 340/734 |
| 4,751,446 | 6/1988 | Pineda et al. | 340/703 |
| 4,752,893 | 6/1988 | Guttag et al. | 364/518 |
| 4,769,762 | 9/1988 | Tsujido | 340/721 |
| 4,772,881 | 9/1988 | Hannah | 340/701 |
| 4,774,678 | 9/1988 | David et al. | 364/518 |
| 4,779,081 | 10/1988 | Nakayama et al. | 340/721 |
| 4,791,580 | 12/1988 | Sherrill et al. | 364/521 |
| 4,800,380 | 1/1989 | Lowenthal et al. | 340/750 |
| 4,801,930 | 1/1989 | Tsuchiya et al. | 340/703 |
| 4,808,989 | 2/1989 | Tabata et al. | 340/750 |
| 4,812,996 | 3/1989 | Stubbs | 364/487 |
| 4,815,010 | 3/1989 | O'Donnell | 364/521 |
| 4,815,012 | 3/1989 | Feintuch | 364/521 |
| 4,823,108 | 4/1989 | Pope | 340/721 |
| 4,823,303 | 4/1989 | Terasawa | 364/521 |
| 4,829,294 | 5/1989 | Iwami et al. | 340/721 |
| 4,862,154 | 8/1989 | Gonzalez-Lopez | 340/747 |
| 4,868,552 | 9/1989 | Chang | 340/721 |
| 4,876,533 | 10/1989 | Barkans | 340/721 |
| 4,894,653 | 1/1990 | Frankenbach | 340/703 |
| 4,943,801 | 7/1990 | Oguchi | 340/723 |
| 4,984,183 | 1/1991 | Ohuchi | 340/724 |

*Primary Examiner*—Ulysses Weldon
*Assistant Examiner*—Xiao M. Wu
*Attorney, Agent, or Firm*—Arnold, White & Durkee

[57] ABSTRACT

This invention allows each of a plurality of windows to use its own distinct datatype and format while more than one window is being displayed on a monitor screen of a computer video graphics system. Different windows can use full color or pseudocolor frame buffer organizations, can use overlay planes or not, and can have other differences in the interpretation of the pixel values without affecting each other. Window dependent pixel datatypes are provided by means of a lookup table that is contained in logic between the frame buffer and the colormap/DAC that drives the monitor. This lookup table contains descriptors for pixel datatypes. It is indexed by a window number that is specified for each pixel. The pixel datatype descriptor accessed at each pixel is then used to control logic that processes that pixel value to create an index for the colormap. This allows each window to specify its own pixel datatype and format, that is used to interpret the pixels contained in the window.

5 Claims, 5 Drawing Sheets

WINDOW DEPENDENT PIXEL DATATYPES IN A COMPUTER VIDEO GRAPHICS SYSTEM

This application is a continuation of application Ser. No. 07/206,091, filed Jun. 13, 1988, now abandoned.

RELATED APPLICATIONS

This invention is related to the following applications, all of which are assigned to the assignee of the present invention and concurrently filed herewith in the names of the inventors of the present invention:

Semaphore Controlled Video Chip Loading in a Computer Video Graphics System, Ser. No. 206,203.

Pixel Lookup in Multiple Variably-Sized Hardware Virtual Colormaps in a Computer Video Graphics System, Ser. No. 206,026.

Datapath Chip Test Architecture, Ser. No. 206,194.

Apparatus and Method For Specifying Windows With Priority Ordered Rectangles in a Computer Video Graphics System, Ser. No. 206,030.

BACKGROUND OF THE INVENTION

This invention relates generally to the field of computer video display systems. More particularly, this invention relates to a computer video graphics system capable of displaying multiple windows with each window displaying an independently selectable pixel datatype and format.

In computer video graphics systems, a monitor displays frames of information provided by a frame buffer or other dual-ported memory many times a second. The subsystem of a video graphics system between the frame buffer and the monitor is called the video datapath. As the format and content of video data becomes increasingly complex, the capability of video displays increases. For example, providing the feature of windows in graphics systems increases the demand on and complexity of the video datapath. Large volumes of digital data in the form of state information are called for to define window boundaries and other window attributes or characteristics. That data must be loaded into state tables in the datapath chips.

Window systems allow graphics workstations to display data from multiple applications at the same time. Space on the display screen is allocated among the different windows. Each window may have different purposes that require differing uses of the planes in the frame buffer. Each different use of the planes of a pixel is a different pixel datatype or format.

There is a traditional distinction between two types of color frame buffers: pseudocolor and full color. As used herein, the term datatype is understood to mean the mode by which a pixel value is interpreted for display on a monitor and the term format refers to all other manipulations performed on pixel values for display. Pseudocolor and full color are two examples of datatypes. Pseudocolor frame buffers use colormaps to select an independent display color for each pixel value. A typical number of planes in a pseudocolor frame buffer is 8, which requires 256 colormap entries. Full color frame buffers typically have 24 planes, which directly drive the digital to analog converters (DACs) for the red, green and blue color channels, using 8 bits for each.

Modern 24 plane displays typically have a "backwards compatibility" mode, in which 8 of their planes are routed through a colormap, which can be selected to drive the display in pseudocolor mode instead of using all 24 planes in full color mode. The mode selection is made for the entire screen at the same time such that the entire screen is either in full color mode or in pseudocolor mode.

Some frame buffers provide one or more overlay planes. However, the overlay planes can only be used for overlays, and all windows that use them must use the same overlay colors.

In a graphics subsystem employing windowing, it is desirable that independent windows on a display screen process pixel values from the frame buffer in different ways. Each window can define its own interpretation of pixel values in the frame buffer out of a wide range of possible pixel datatypes.

It is also desirable that multiple windows use their own distinct pixel datatypes while being displayed simultaneously on the screen. In this way, different windows can use full color or pseudocolor frame buffer organizations, can use overlay planes or not, and can have other differences in their interpretation of the pixel values without affecting each other. For example, in a 24 plane frame buffer, one window may use 8 plane pseudocolor pixels, so that 8 of the planes select one of 256 colors. Another window may occupy all 24 planes, using 8 planes each to drive the red, green, and blue channels of the monitor. A third window may require overlay planes, or may only need a smaller number of colormap entries. In such a system all of these windows can be displayed simultaneously, with the correct pixel datatype and format used to interpret the values of the pixels belonging to each window.

SUMMARY OF THE INVENTION

The present invention is generally directed to solving the foregoing and other problems, as well as satisfying the recited shortcomings of known computer graphics systems.

Window dependent pixel datatypes are provided by means of a lookup table that is contained in logic between the frame buffer and the colormap/DAC that drives the monitor. This lookup table contains descriptors for pixel datatypes. It is indexed, or pointed to, by a window number that is specified for each pixel. The pixel datatype descriptor accessed at each pixel is then used to control logic that processes that pixel value to create an index for the colormap. This allows each window to specify its own pixel datatype, that is used to interpret the pixel contained in that window.

This invention processes pixels read from the frame buffer into the video datapath. Each pixel is processed according to the pixel datatype and format specified for the window that contains it. This requires two things: a means to specify the window that contains each pixel, and a means to use that information to convert the pixel value read from frame buffer into an index into a colormap.

This invention implements window dependent pixel datatypes with a lookup table. As pixels are read from the frame buffer, their window numbers are used to index a lookup table of pixel datatypes. This invention allows pixel datatypes to be different for each pixel, depending only on the window number that is specified for that pixel and the pixel datatype specified for that window in the lookup table.

BRIEF DESCRIPTION OF THE DRAWINGS

The above-noted and other aspects of the present invention will become more apparent from a description of the preferred embodiment when read in conjunction with the accompanying drawings.

The drawings illustrate the preferred embodiment of the invention, wherein like members bear like reference numerals and wherein.

DESCRIPTION OF A PREFERRED EMBODIMENT

Figure 1:
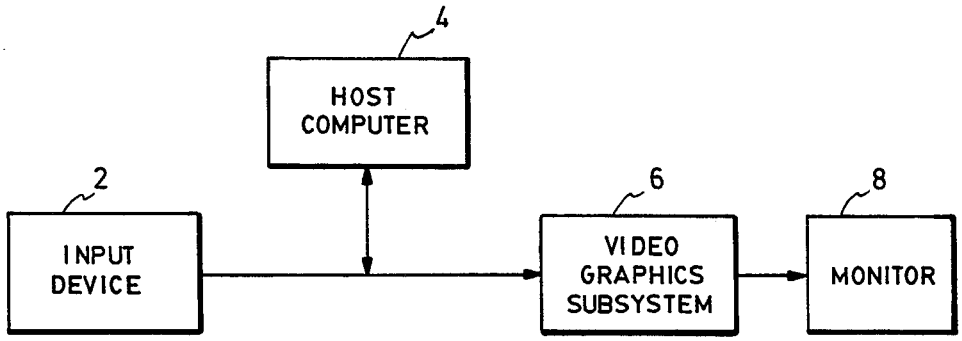
FIG. 1 is a general block diagram of a computer video graphics system employing the invention.

Referring to FIG. 1, a general block diagram of a video graphics system which employs the present invention is shown. An input device 2 functions as the means by which a user communicates with the system, such as a keyboard, a mouse or other input device. A general purpose host computer 4 is coupled to the input device 2 and serves as the main data processing unit of the system. In a preferred embodiment, the host computer 4 employs VAX architecture, as presently sold by the assignee of the present invention. A video graphics subsystem 6 receives data and graphics commands from the host computer 4 and processes that data into a form displayable by a monitor 8. The video graphics subsystem 6 features the use of large volume state tables for storing state data. According to the invention, the video graphics subsystem 6 is specially adapted to provide for displaying a plurality of windows each of which may be displayed in pseudocolor, full color or in other selected datatypes. In a preferred embodiment, the monitor 8 is an RGB CRT monitor.

Figure 2:
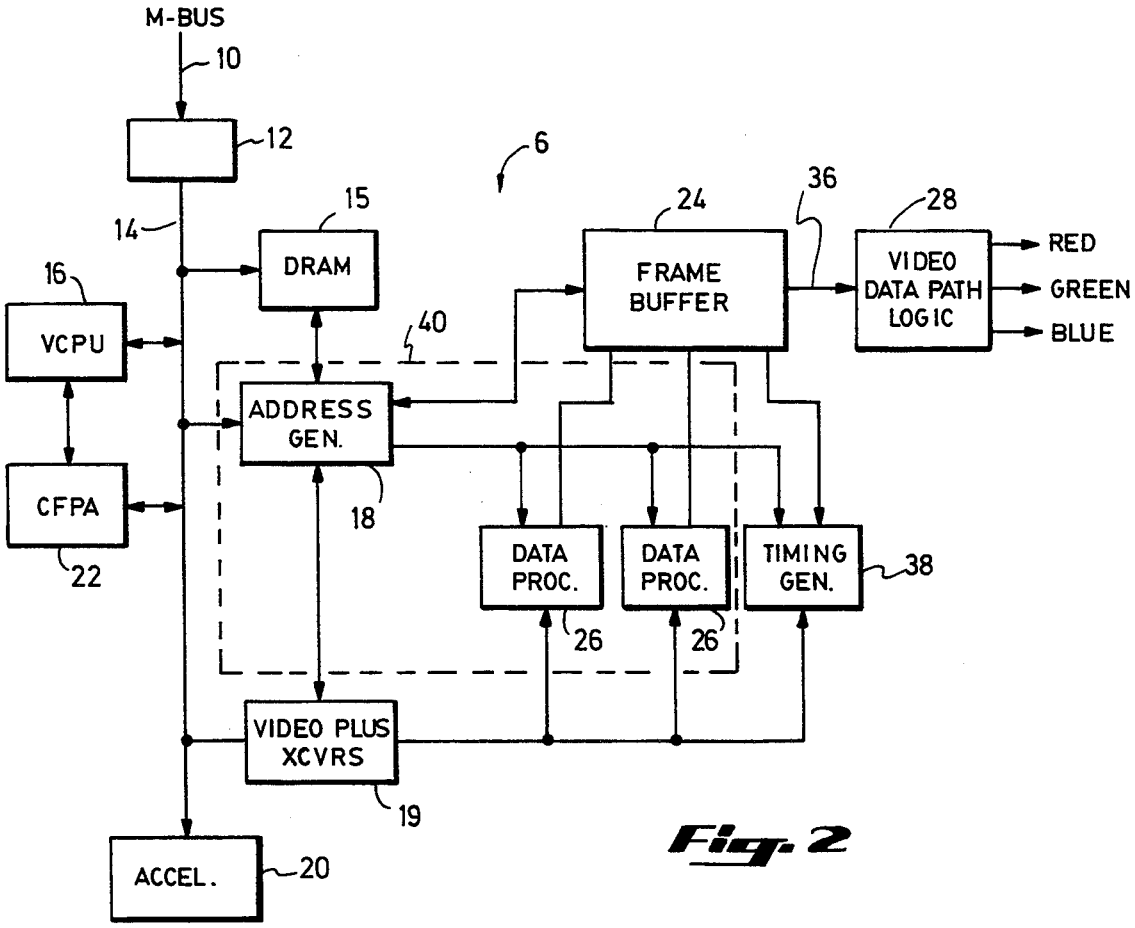
FIG. 2 is a block diagram of a video graphics subsystem employing the present invention.

Referring now to FIG. 2, an embodiment of a video graphics subsystem 6 which employs the present invention is shown. This graphics subsystem is an interactive video generator which may be used for two-dimensional (2D) and three-dimensional (3D) graphics applications.

The graphics subsystem 6 receives graphics commands and data from the host Central Processing Unit (CPU) in the host computer 4 by way of a memory bus (M-Bus) 10. The host CPU communicates with a video graphics subsystem bus (VI-Bus) 14 by way of an interface 12. The interface 12 performs all functions necessary for synchronous communication between the M-Bus 10 of the host CPU and the VI-Bus 14 of the graphics subsystem 6. The interface 12 is of conventional design and decodes single transfer I/O read and write cycles from the M-Bus and translates them into VI-Bus cycles for the graphics subsystem in a manner known in the art. The interface 12 also supports Direct Memory Access (DMA) transfers over the M-Bus 10 between the workstation main memory in the host computer 4 and a video graphics system dynamic random access memory (DRAM) 15. DMA transfer is a technique known in the art whereby a block of data, rather than an individual word or byte, may be transferred from one memory to another.

A graphics subsystem CPU (VCPU) 16 is provided as the main processing unit of the video graphics subsystem 6. All requests by the host CPU for access to the graphics subsystem (via the M-Bus10/interface 12) go through an address generator 18 which serves as the arbitrator for the VI-Bus 14. There are three possible masters seeking access to the VI-Bus 14: the VCPU 16, the interface 12 and an accelerator 20. The address generator 18 grants bus mastership on a tightly coupled, fixed priority basis. The VCPU 16 is the default bus master. The accelerator 20 serves as a co-processor with the VCPU 16.

The VCPU 16 also employs a floating point unit (CFPA) 22. The VCPU 16/CFPA 22 form the main controller of the graphics subsystem 6. This combination loads all graphics data to the graphics subsystem, provides memory management, an instruction memory, and downloads the initial code store of the accelerator 20.

As used herein, the term graphics rendering is understood to mean the process of interpreting graphics commands and data received from the host CPU 4 and generating resultant pixel data. The resultant pixel data is stored in so-called on-screen or off-screen memory in a frame buffer 24. The graphics rendering section of the graphics subsystem is implemented in the address generator 18 and a set of data processors 26. These logic elements translate addresses received from the host CPU 4 into pixel data addresses and manipulate pixel data. The address generator 18 and the data processors 26 make up a pixel drawing engine 40. Video bus transceivers (XCVRs) 19 perform a read/write function to accommodate the additional load on the VI-Bus 14 by the data processors 26 and the timing generator 38.

As used herein, the term graphics display is understood to refer to the process of outputting the pixel data from the frame buffer 24 to a viewing surface, preferably the monitor 8. A video data rate stream of pixel data applied directly to the system without the use of a frame buffer may also provide the data to the system for display.

Figure 3:
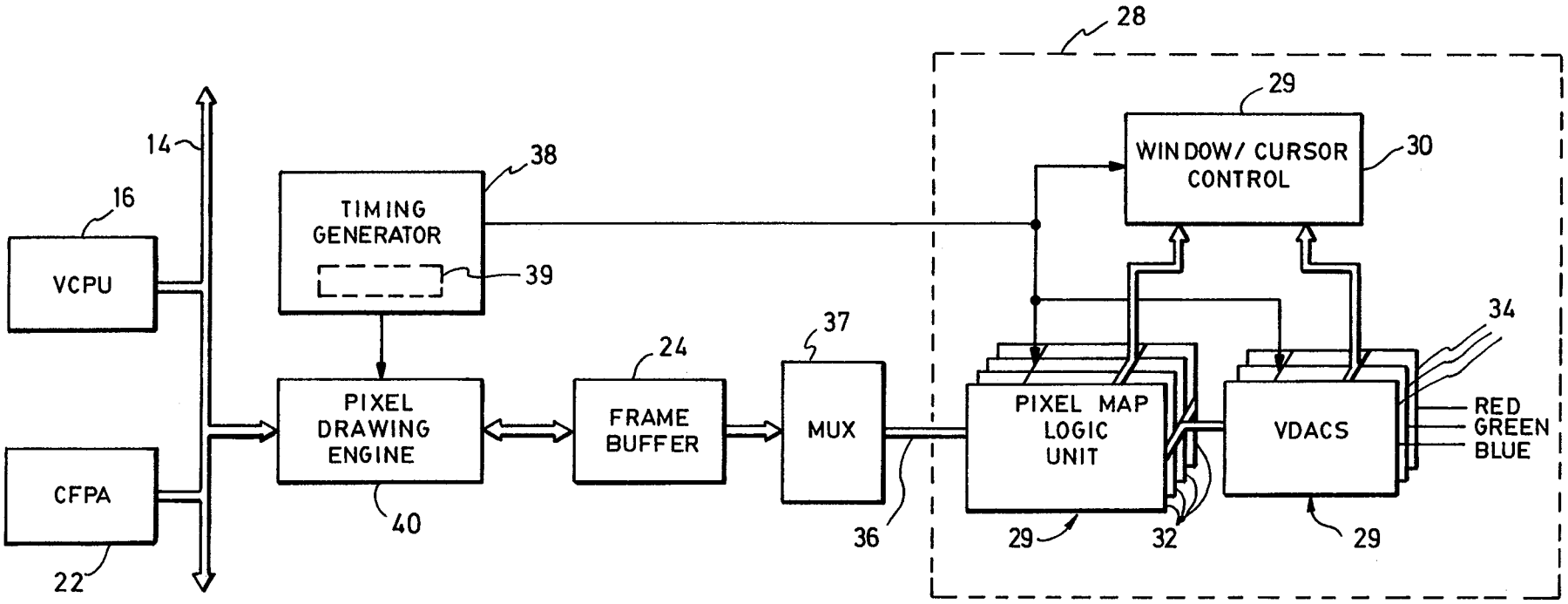
FIG. 3 is a block diagram showing further detail of a video graphics subsystem employing the present invention.

A video graphics datapath logic section 28 of the graphics subsystem of FIG. 2 is provided. Referring to FIG. 3, the logic section 28 comprises a window/cursor control 30, a set of pixel map logic units 32 and a set of colormaps and digital to analog converters (VDACs) 34. Collectively, the window/cursor control 30, the pixel map logic units 32 and the VDACs 34 may be referred to hereinafter as the video graphics or data path logic units 29. In a preferred embodiment, one window/cursor control 30, four pixel map logic units 32 and three VDACs 34 are provided and each of these data path logic units is implemented on a single integrated circuit chip. The video graphics data path logic section 28 defines the windows on the screen and determines the source within the frame buffer 24 which will provide the pixel data for the current window. The video graphics data path logic section 28 also converts the digital information in the video graphics subsystem to an analog form to be displayed on monitor 8. This data includes bitmap memory, overlay plane or cursor, as described more fully with relation to FIGS. 4–6.

FIG. 3 depicts a preferred embodiment of the present invention for loading data into data path logic unit registers (state tables) in the video data path logic section 28. These data are stored in so-called off-screen scanlines of the frame buffer 24 and are loaded automatically into the window/cursor controls 30, the pixel map logic units 32 and the VDACs 34 by the screen refresh process starting after the last displayable scan. Data for the data path logic units 29 are sequentially loaded through one of the four-bit inputs 36 starting with the least significant bit ("LSB") of the first data path logic unit register ("register <0>") in the data path proceeding through the most significant bit ("MSB") of the last register of the last data path logic unit 29. Each input 36 is four bits wide so that data can be transferred and processed at one quarter of the full pixel rate. There are also sufficient inputs 36, each four bits wide, to carry all the bits in a pixel; for example, if 24 bits define a pixel, there will be 24 such inputs 36. There may also be additional inputs 36 to accommodate cursor data and overlay plane data as described below. A multiplexer 37 takes the data in the frame buffer 24 and feeds this data to the data path logic units 29 serially. Logic (not shown) generates the sequential addresses for the various registers in the data path logic units 29 in a manner known in the art.

A timing generator 38 is provided to control the loading and output of display data in on-screen memory of frame buffer 24, the loading of data in off-screen memory for the video output logic section 28 by using a semaphore 39 and the generation of timing signals for the monitor 8. Off-screen memory of the frame buffer 24 includes a copy of the data in the state tables of the data path logic units 29. The timing signals for the monitor 8 include conventional horizontal and vertical synchronization (sync) and blank signals.

Figure 4:
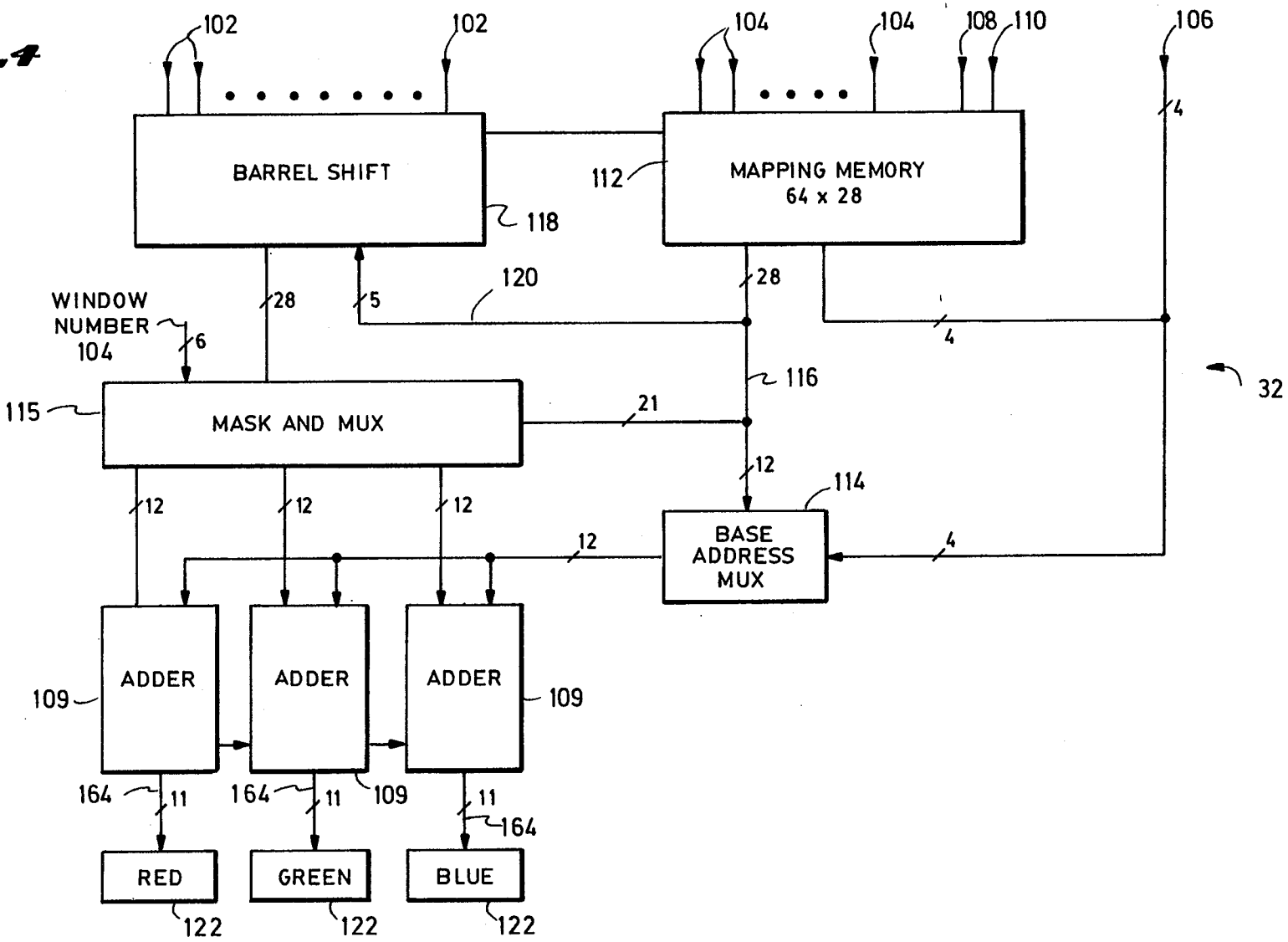
FIG. 4 is a block diagram of a pixel map logic unit which is employed to carry out the present invention.
Figure 5:
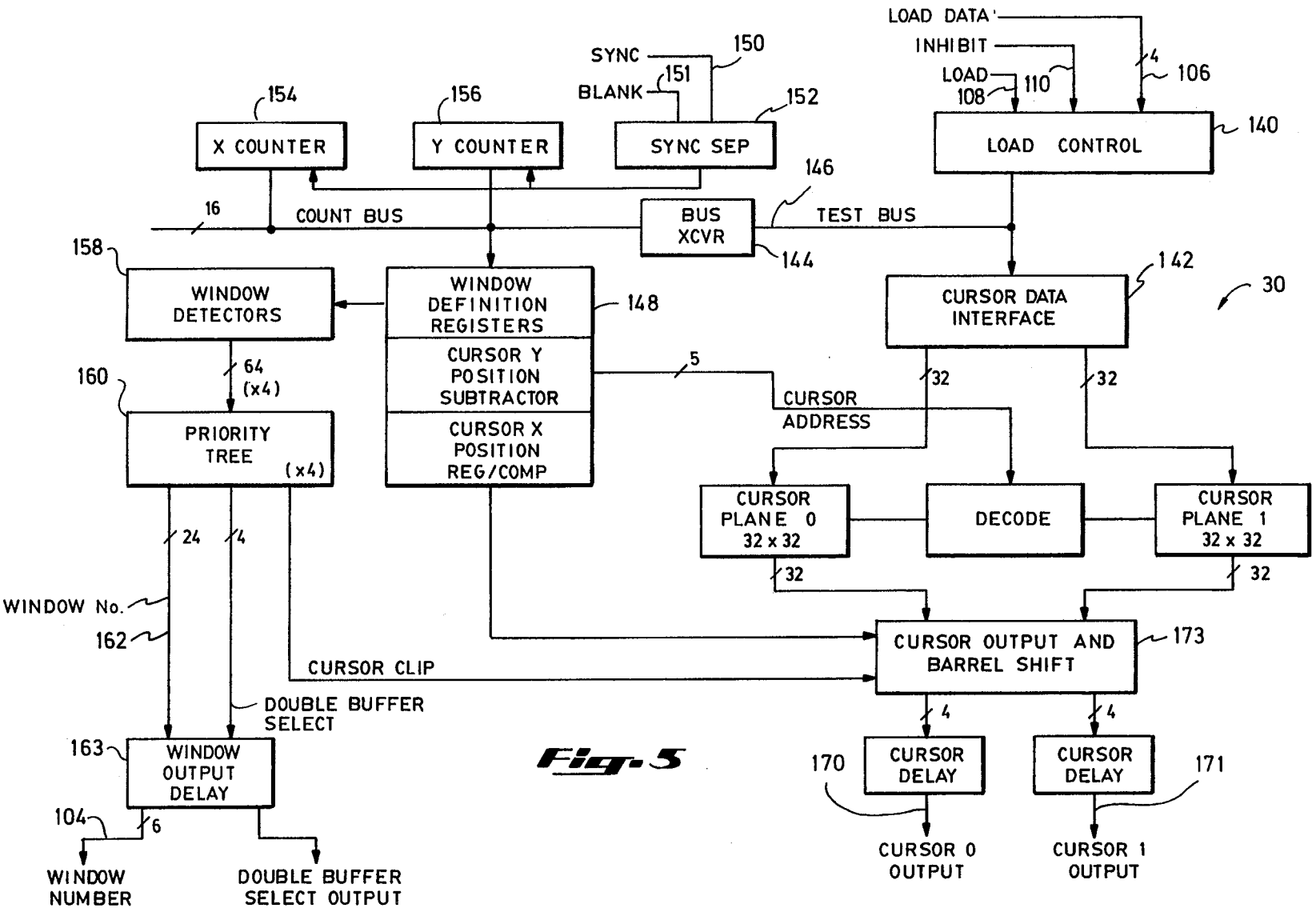
FIG. 5 is a block diagram of a window/cursor control which is employed to carry out the present invention.
Figure 6:
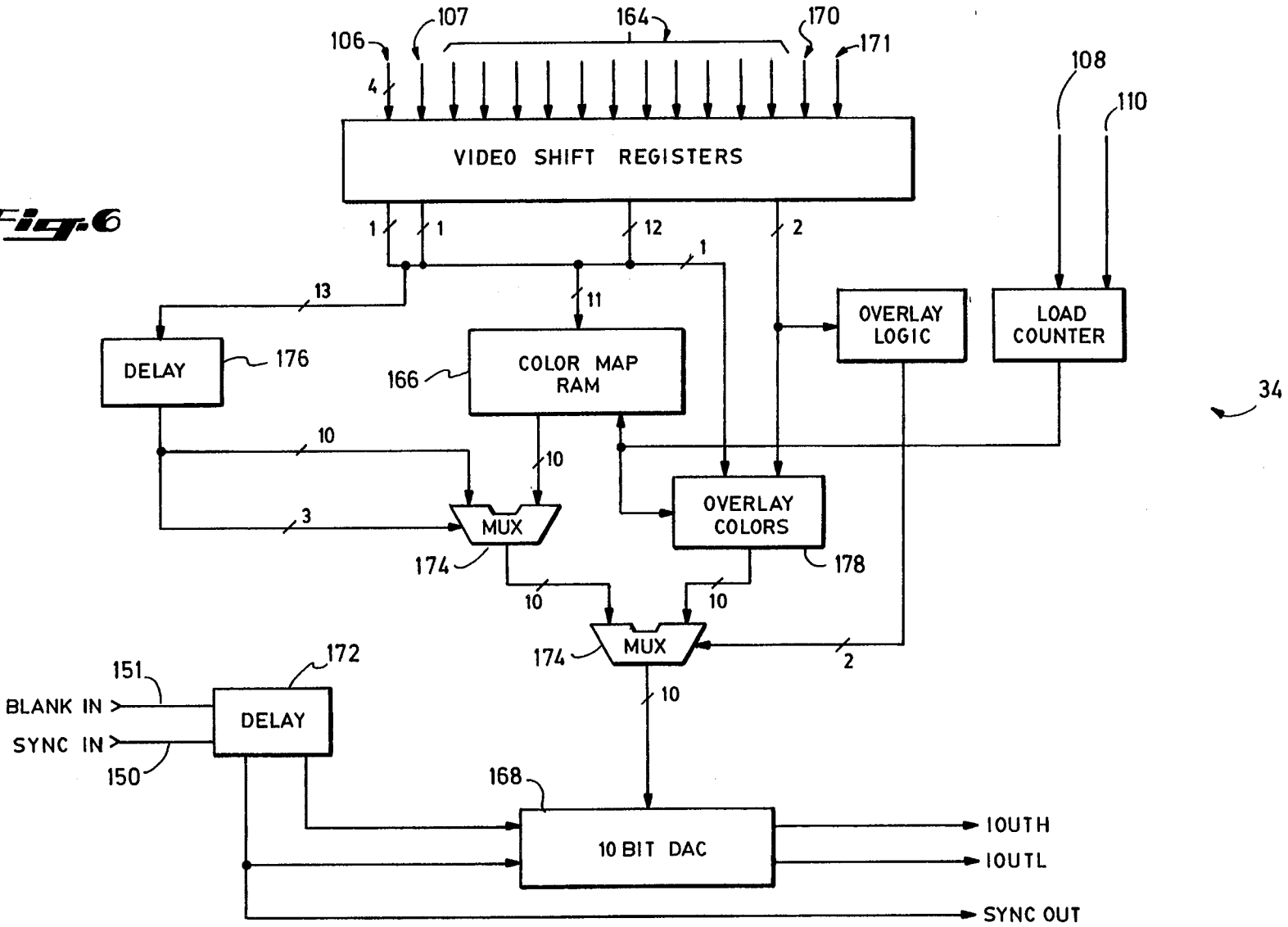
FIG. 6 is a block diagram of a video digital to analog converter which is employed to carry out the present invention.

Referring now to FIGS. 4, 5 and 6, a preferred embodiment of the present invention is illustrated. Bit sizes of the various buses and registers, shown in the conventional manner, are exemplary only, and are not by way of limitation. It is to be understood that FIGS. 4, 5 and 6 illustrate the primary flow paths of data and are not intended to illustrate all control lines. For example, for proper operation, the various circuit components are presumed to be provided with a proper clock signal in a conventional manner.

FIG. 4 illustrates a preferred embodiment of the pixel map logic unit 32. Pixel data from the on-screen memory of frame buffer 24 via multiplexer 37 is input to the pixel map logic unit 32 via a set of data input lines 102. The data input lines 102 carry sufficient bits to define a pixel, in a preferred embodiment 24 bits. Additional data input lines 102 may be provided to accommodate overlay planes. The number of bits in the data input lines 102 equals the number of planes in the frame buffer 24. In a preferred embodiment, a 24 plane frame buffer provides 24 bits per pixel.

The pixel map logic unit 32 is provided with a window number input 104. The window number input 104 carries sufficient bits to select one of a plurality of windows, such as for example, 64 windows. The window number input 104 provides a window number from the window/cursor control 30, an embodiment of which is shown in FIG. 5 and described below. A window number is input for each pixel.

The LOAD input 108 and the INHIBIT input 110 are provided to control the loading of data into the various registers in the pixel map logic unit 32. A load data input 106 provides the data from the off-screen memory of the frame buffer 24 via multiplexer 37 to be loaded into the various registers under the control of the LOAD input 108 and the INHIBIT input 110.

On each clock pulse, a pixel value at the pixel data input lines 102 and a window number at window number input 104 are input into the pixel map logic unit 32. The window number input 104 determines how the pixel values at the pixel input lines 102 are processed to form a set of three 11 bit index values 164. The mapping information is stored in a mapping memory 112, one of the pixel map logic unit's state tables, which is addressed by the window number input 104.

As understood from FIG. 4, the load data input 106 loads the mapping memory 112. In a preferred embodiment, the mapping memory 112 contains register space for 64 mapping configuration words, one mapping configuration word for each window number. The mapping configuration words and their use in a preferred embodiment are explained more fully below.

In loading the mapping memory 112, the load data input 106 provides a base value to a base value lookup table within mapping memory 112. The pixel map logic unit 32 processes pixel data from the frame buffer 24 according a specified pixel datatype and format for each window. The processed pixel value produced in the pixel map logic unit 32 is then converted into an index into a physical colormap in the VDACs 34. These index values are indicated in FIG. 4 as set of index values 164 and are input into the VDACs 34 as shown in FIG. 6. This conversion is accomplished by adding a base value from the mapping memory 112 via a base address MUX 114 to the pixel value. The base value is selected based on the window containing this pixel. The pixel value is therefore a relative index into a window's virtual colormap, which is pointed to by the base value.

One example of the mapping configuration word is as follows:

| 27 | 26 25 | 24 20 | 19 16 | 15 12 | 11 0 | |
|---|---|---|---|---|---|---|
| V | Mod | Shift | Mask | #Planes | Base Value | bit field |

The mapping configuration word is broken into fields as shown to control the various sections of the pixel map logic unit 32. One of the mapping configuration words is output from the mapping memory 112 onto the mapping configuration word bus 116. The most significant bit of the mapping configuration word, shown in the above example as bit <27>, provides each of the windows to be displayed with the capability to use a valid plane. If this bit is "0", then this field has no effect on the mapping process. If this bit is "1", then the least significant bit of each pixel is used to determine whether normal mapping takes place ("1") or a background color is displayed for that pixel.

According to the present invention, the mode field (bits 25 and 26) dictates the selected datatype and determines how the pixels in the window having that mapping configuration word are interpreted and displayed. For example, in a preferred embodiment, a logical "00" in bits 25 and 26 sets a pseudocolor mode. In this mode, the pixel value input to a barrel shift 118 is shifted by a number of bits equal to the digital value on the shift field of the mapping configuration word. The shift field carries, for example, 5 bits which are input into the barrel shift 118 via a shift bus 120. Shifting each pixel value in this way permits, for example, multiple windows to take bits from different parts of the same pixel. This shifted pixel value is input to a mask unit (Mask and Mux) 115 which masks selected bits of the shifted pixel value as determined by the mask field of the mapping configuration word to develop a modified pixel value. This modified pixel value represents a computed relative colormap index. The same modified pixel value is then multiplexed into a set of adders 109 where it is added to the base value from a base address multiplexer (Mux) 114. Thus, pseudocolor mode results in the same index values 164 into a set of colormaps 122, shown in FIG. 6 as a color map RAM 166.

For full color mode, the mode field may be set at, for example, a logical "01" value in bits 25 and 26 of the mapping configuration word. In this mode, each pixel value at the pixel inputs 102 is shifted by the barrel shift 118 and input into the mask unit 115, as it was in pseudocolor mode. But, unlike pseudocolor mode, the pixel value is then divided into three distinct channels in the mask unit 115, and, when added to a base value in the adders 109, these channels form three distinct color look-up indices 164 into the colormaps 122. In this way, each pixel is processed according to its own datatype and format.

Referring now to FIG. 5, the window/cursor control 30 which may be employed in carrying out the present invention is shown. The window/cursor control 30 provides two basic functions, hardware window support and hardware cursor support.

As with the pixel map logic unit 32, the window/cursor control 30 is responsive to the LOAD input 108 and the INHIBIT input 110. Also as with the pixel map logic unit 32, data is loaded into the window/cursor control 30 by way of the load data input 106. The load data input 106 inputs data into a load control 140 which either enables or disables the loading of data. If the data is to be loaded, the data is sent to a cursor data interface 142 or to a bus transceiver (XCVR) 144 as dictated by the internal logic of the window/cursor control 30 in a manner known in the art. A test bus 146 is provided, and it is a bi-directional bus. The bus transceiver 144 permits data to be sent from the test bus 146 to a set of window definition registers 148 or to permit the data from the window definition registers 148 to be written onto the test bus 146.

A sync input 150 provides a composite signal which includes information about the horizontal and vertical sync signals of the video graphics subsystem 6. A sync separator (Sync Sep) 152 is provided to separate the vertical and horizontal sync signals to provide clock signals to an X counter 154 and to a Y counter 156. Thus, the window/cursor control 30 calculates the position of the CRT refresh logic for the monitor 8 via a set of internal X and Y counters. By using the monitor's sync signal via the sync input 150 and the monitor's blank signal via blank input 151, the window/cursor control 30 is able to keep these counters synchronous with the refresh and retrace cycles of the monitor 8. At all times, the values of the X Counter 154 and the Y Counter 156 correspond with the actual refresh process on the CRT 8. On every clock cycle, these counter values are compared with the programmed cursor position and all of the window definition registers 148. The origin is in the upper left, with increasing X values to the right and increasing Y values downward.

The window/cursor control 30 has two primary sections, a cursor section which comprises the cursor data interface 142 (and the elements that it communicates with) and a window section which comprises the Bus XCVR 144 (and the elements that it communicates with). The window section computes three sets of outputs. The first is the window number which for each pixel, is sent to the pixel map logic units 32. Next, the window/cursor control 30 computes a double buffer select signal which is used to select one of two banks of RAM chips to enable double buffering on a per window basis. The final value that the window/cursor control 30 computes is used internally as clipping information for the cursor and is used to allow the cursor to appear in selected windows. This feature may be used when displaying a hairline cursor in a window. This signal will clip the cursor allowing it to appear only in unoccluded portions of selected windows.

The cursor section computes two values, a cursor 0 output 170 and a cursor 1 output 171. These values are input to VDACs 34 as an index into the hardware colormap as described with regard to FIG. 6 to display a sprite cursor in a manner known in the art.

The window definition registers 148 send window definitions to a set of window detectors 158. If two or more windows overlap, then the overlap will encompass pixels within both windows. The window detectors 158 in turn provide window descriptions to a priority tree 160. The priority tree 160 determines, of those windows defined, which are the highest priority for each pixel. In other words, if window A and window B overlap and window A covers up part of window B, window A has the higher priority and will be assigned on a window no. output 162. If a particular pixel is not contained in any window, default window mapping is output as a background. A window output delay 163 is provided to coordinate the output of the selected window number to the pixel map logic unit 32 with other system delays.

Referring to FIG. 6, one example of the VDAC 34 which employs the present invention is shown. One such VDAC 34 is provided for each of the red, green and blue channels of the monitor 8. The VDAC 34 includes the LOAD input 108 and the INHIBIT input 110 to control the loading of the various registers of the VDAC 34

The pixel map logic units 32 provide the set of index values 164 for each of the red, green and blue channels of the VDAC 34. Each of the index values 164 is four bits wide (one bit from each of the four pixel map logic units 32). Since each index value 164 indexes a location into a color map RAM 166, each window can use a different portion of color map RAM 166, and each window is provided with full color or pseudocolor independently of other windows, depending only on the datatype selected for each window. Similarly, cursor 0 input 170 and cursor 1 input each indexes its own location into a colormap to provide for a three colored cursor that can therefore be seen against any color of background or window. Each bit is then routed via a set of multiplexers 174 to a DAC 168 where it is converted to an analog value which drives either the red, green or blue channel of the monitor. The blank signal via blank input 151 and sync signal via sync input 150 are input to adjustable delay 172 to compensate for other delays in the video graphics subsystem. The mapping scheme as herein described can be optionally disabled by map enable input 107. Asserting map enable input 107 bypasses color map RAM 166 through delay 176 which provides sufficient delay to match that of color map RAM 166. In a preferred embodiment, the DAC 168 is capable of driving a one volt ground referenced RS343 compatible video into a 75 ohm cable.

Cursor 0 input 170 and cursor 1 input 171 are used to select pixel by pixel between video data or three overlay colors. When both cursor 0 input 170 and cursor 1 input 171 are zero, the video data is selected. The three other input states select one of three overlay color registers in an overlay colors register 178. The overlay colors register 178 is updated by data from the load data input 106 under the control of the LOAD input 108 and the INHIBIT input 110 in accordance with the present invention. Thus, a cursor may have colors different from all the colors in the color map RAM 166.

The principles, preferred embodiments and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention.

What is claimed is:

1. In a computer video graphics system capable of displaying a plurality of windows on a monitor, the system having a frame buffer having pixels, a plurality of color lookup tables, and a processor including an electronically alterable mapping memory, a method of displaying different datatypes and formats for different windows comprising the steps of:

a. providing a window number for each pixel in the frame buffer;

b. providing a mapping configuration word corresponding to each window number, each of said mapping configuration words comprising a mode field, a shift field, a pixel bit mask field, and a color map base address field;

c. for each window, performing steps comprising:

shifting each pixel value of the window by an amount contained in the shift field of the mapping configuration word associated with the window;

masking selected bits of the shifted pixel value, said selected bits determined by the pixel bit mask field of the mapping configuration word associated with the window;

in the event the mode field of the mapping configuration word associated with the window matches a first selected value, processing the pixel values by multiplexing the masked pixel value and adding each multiplexed pixel value to the color map base address field; and in the event the mode field of the mapping configuration word associated with the window matches a second selected value, processing the pixel values by dividing the masked pixel value into multiple color channels and adding each of said color channels to the color map base address field; and d. providing the processed pixel values to the color lookup tables for display.

2. The method of claim 1 further comprising the step of interpreting the processed pixel values as index values into a color lookup table.

3. The method of claim 1 further comprising the step of producing three distinct index values from the processed pixel values for indexing respectively values in a red, green and blue color lookup table.

4. The method of claim 3 further comprising the step of displaying the indexed color lookup table values on a monitor.

5. In a computer graphics system, a subsystem for providing pixels of selected datatypes and formats to more than one window for simultaneous display on a monitor, comprising:

a. means for providing a window number for each pixel;

b. an electronically alterable mapping memory having a mapping configuration word corresponding to and indexed by each window number defining a selected datatype and format for each window, each of said mapping configuration words comprising a mode field, a shift field, a pixel bit mask field, and a color map base address field;

c. one or more color lookup tables for providing color values to be displayed on the monitor;

d. means for providing pixel values to the subsystem to be interpreted for display;

e. a barrel shift for shifting a pixel value in accordance with the shift field of the mapping configuration word associated with said pixel value;

f. a mask and mux for either multiplexing the shifted pixel value or dividing the shifted pixel value into multiple channels, depending upon the format provided by the mode field of the mapping configuration word associated with said pixel value; and g. one or more adders for adding each multiplexed or added pixel value to the color map base address field.

* * * * *